United States Patent [19]

Yip et al.

[11] Patent Number: 4,996,930

[45] Date of Patent: Mar. 5, 1991

[54] FEED SYSTEM FOR INCINERATION OF CONTAMINATED MATERIAL

[75] Inventors: Harry H. Yip; Niles W. Johanson; Walter Egli, all of San Diego, Calif.

[73] Assignee: Ogden Environmental Services, Inc., San Diego, Calif.

[21] Appl. No.: 439,880

[22] Filed: Nov. 21, 1989

[51] Int. Cl.[5] ..... F23G 5/00; F23G 7/00

[52] U.S. Cl. ..... 110/245; 110/110; 110/223; 110/346; 241/280

[58] Field of Search ..... 110/110, 346, 101, 223, 110/245; 241/280

[56] References Cited

U.S. PATENT DOCUMENTS

| | | | |
|---|---|---|---|
| 3,921,545 | 11/1975 | Ruegsegger | 110/101 X |
| 4,493,270 | 1/1985 | Gamroth | 110/110 X |
| 4,553,285 | 11/1985 | Sachs et al. | 110/223 |
| 4,702,177 | 10/1987 | Narisoko et al. | 110/110 |
| 4,803,836 | 2/1989 | Blanton et al. | 110/110 X |

OTHER PUBLICATIONS

Ives et al., PCB Remediation in Alaska, PCB Forum, Aug. 1989, pp. 1-20.

Ogden Environmental Services, Circulating Bed Combustion (Brochure), no date.

*Primary Examiner*—Edward G. Favors

*Attorney, Agent, or Firm*—Fitch, Even, Tabin & Flannery

[57] ABSTRACT

A method for incinerating contaminated soil or other material utilizing an incinerator, such as a CBC, which is operated below atmospheric pressure and apparatus for carrying out such decontamination by delivering the soil to be processed in desired particulate size to the incineration unit, e.g., to a recirculation loop through which separated solids are being returned from a cyclone to a CBC. The system for supplying the contaminated soil is isolated from the chute leading to the incineration unit by a feeder that forms an agglomerated plug which serves as a pressure seal and prevents any gas flow therepast. Illustrated are a pair of twin counterrotating screws which include shafts that extend past the ends of the screw flights to locations where rotary cutters having multiple blades are mounted. Soil being carried between the flights of the rotating screws continuously agglomerates to form a plug at the downstream end which continuously advances toward the cutter blades that slice it into chips of desired thickness, which then pass through all or a portion of a pug-mill before entering a chute leading to the incinerator. The screws and rotary cutters are advantageously mounted on common shafts so as to allow longitudinal adjustment of the distance between the cutter and the screw to vary the length of the plug.

11 Claims, 3 Drawing Sheets

DRIVE

FEED SYSTEM FOR INCINERATION OF CONTAMINATED MATERIAL

This invention relates generally to the cleanup of contaminated hazardous waste sites and more particularly to systems and methods for feeding contaminated earth or other material to an incineration unit, such as a circulating bed combustion unit, which is operated to successfully destroy hazardous waste components by thermal oxidation without the discharge of harmful emissions to the atmosphere.

BACKGROUND OF THE INVENTION

There are numerous contaminated hazardous waste sites throughout the United States of America and in other countries throughout the world which, if allowed to remain untreated, have the potential for creating long term odor and/or health problems. In recent years, these situations have begun to attract the attention of environmentalists and others, and both government and industry have begun to focus on the immediate problems and the potential future problems posed by such sites. In the United States, Congress has created the Superfund to defray the expenses for the clean-up of some of the more potentially hazardous of these sites.

Containment of such hazardous waste material, either on-site or off-site, does not eliminate the problem, but merely defers it or transfers it. However, it has now been proven that incineration of these hazardous materials can be used to effect thermal destruction of the hazardous organic components leaving generally inorganic residues in uncontaminated condition which can be returned to the excavation from which the contaminated soil was removed.

Although incineration generally is eminently feasible for cleanup of such contaminated soil, the operation must be carried out in the United States under conditions that will meet the strict standards set by the Environmental Protection Agency (EPA) so that no significant amounts of hazardous, or potentially hazardous, inorganic components exit along with the stack gas and so that residue from such an incineration method is no longer hazardous so it can preferably be returned to the site of removal. Moreover, such incineration should be capable of operation with relatively high efficiencies so as to accomplish the decontamination of large amounts of contaminated soil in a reasonable period of time and under widely varying environmental conditions of high and low temperatures and varying moisture contents. Research efforts in this area have been continued in an effort to better achieve such objectives in a commercially feasible manner.

SUMMARY OF THE INVENTION

A method for using incineration to decontaminate contaminated soil or the like has been developed which utilizes an incineration unit, such as a circulating bed combustor (CBC), which is operated generally at pressures below atmospheric pressure. Contaminated material is efficiently delivered to the incineration unit via a feeder which continuously agglomerates the material in a manner to create a plug which seals the feeder and blocks gas flow therethrough, segregating the entrance to the incineration unit from the ambient conditions at which the contaminated soil is being delivered to the feeder and allowing the CBC or other incinerator to be operated at a pressure other than atmospheric pressure.

Portions of the downstream end of the agglomerated plug are continuously removed and suitably fed to the incinerator; for example, they can be fed to a CBC via a recirculation loop through which particulate solids are returned after their separation from the fluid exhaust stream leaving the CBC.

Apparatus for use in carrying out this decontamination method is provided which includes a suitable feeder which performs such continuous agglomeration to create a plug and then slices portions from the downstream end thereof of a size desired for delivery to the incineration unit. Preferably, a pair of intermeshing, counterrotating screws are used to create a plug of appropriate size at the discharge end of a barrel or housing, from the downstream end of which plug the slices are produced. Preferably, the sliced pieces of desired size are fed by gravity through a chute leading to the incinerator, e.g., to the CBC recirculation loop where they are commingled with the returning solids.

DETAILED DESCRIPTION OF THE PREFERRED EMBODIMENTS

Figure 1:
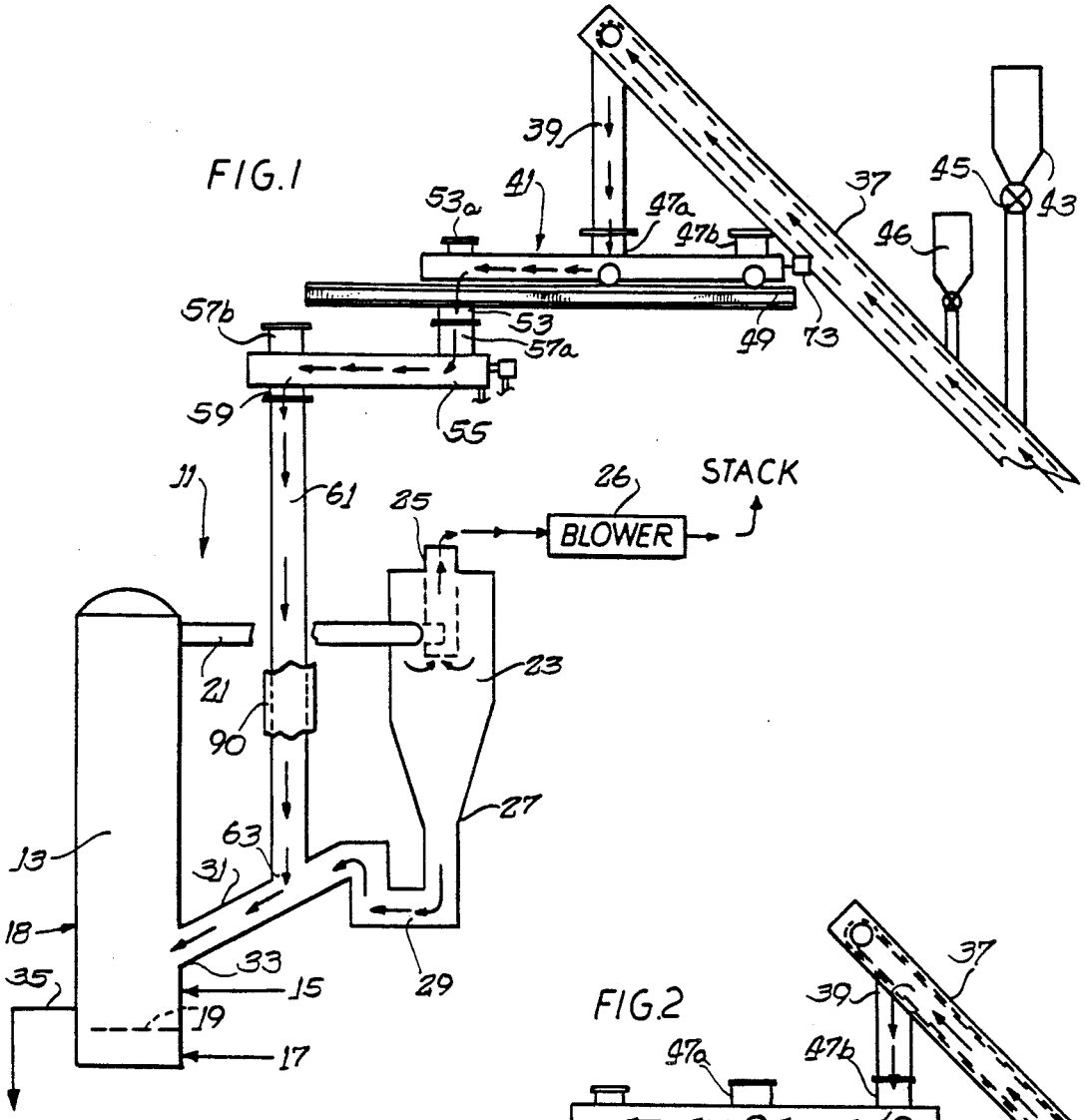
FIG. 1 is an overall schematic view showing apparatus for carrying out a method of decontamination of soil embodying various features of the invention.

Shown in FIG. 1 is apparatus particularly designed for use in the cleanup of a contaminated hazardous waste site by excavation and incineration of the contaminated soil. An incineration unit in the form of a circulating fluidized bed combusting unit 11 is shown which includes a combustion chamber or combustor 13 having a lower inlet 15 through which natural gas or a carbonaceous solid material, such as crushed coal, is fed into the combustion chamber where a fluidized bed of particles is maintained. An inlet 17 leads to a plenum chamber at the bottom of the combustor formed by a perforated plate 19 through which fluidizing and oxidizing air is supplied. Air is supplied at a suitable pressure and flow rate sufficient to entrain the solid particulate material and thereby create a fluidized bed. For initial start-up, beach sand or the like can be used to create a fluidized bed that is gradually replaced by the soil that is being decontaminated. Additional or secondary air can be fed into the combustor 13 through an upper inlet 18, if desired, as well known in this art. Although a CBC is preferred, other incinerators which are operable under subatmospheric pressures may be used.

The combustion products exit from the combustor 13 via an upper outlet 21 which leads to a cyclone separator 23 wherein solid particles carried by the exhaust gas stream are separated therefrom, and the gases, now cleaned of particulate matter, exit from an upper outlet 25 which normally eventually leads to a stack. Before discharge to the stack, the gas stream may be subjected to one or more ancillary treatments as required by environmental conditions, for example, to reduce $NO_x$ and/or $SO_x$ and to final bag filtration. A large blower 26 as is well known in this art is arranged to take its suction from the gas outlet 25 and is operated to maintain the circulating combustion unit at the desired amount below atmospheric pressure. The solid particles separated from the gas streams fall by gravity to a bottom outlet 27 which leads to a recirculation loop 29 that includes a U-shaped section, as is well known in this art. The U-shaped section leads to a downward diagonal section 31 that terminates at an inlet 33 to the combustor spaced slightly above the fluidizing plate 19. As is well known in this art, fluidizing air is injected into the recirculation loop 29. If desired, instead of a vertical cyclone separator 23, some other suitable separating device can alternatively be employed, for example a horizontally-oriented cyclone.

In order to effect efficient supply to the CBC, the contaminated soil, earth or other material is preferably elevated above the level of the recirculation loop and is delivered by gravity to the loop where it mixes with the returning particles that were separated in the cyclone 23, at least a sufficient portion of which are returned to maintain the bed at the desired operating size. In the illustrated embodiment, all of the separated particles are returned through the opening 33, and a side stream is removed through a side outlet 35 on the opposite side of the combustor, just above the fluidizing plate 19, to maintain the bed at its desired size. More specifically, a conveyor of any suitable construction, for example a drag-link conveyor 37, is employed to elevate the soil which is suitably delivered to the lower end of the conveyor from a hopper equipped with feed screws or the like, which is used to control the rate of flow of contaminated material through the decontamination process. As the soil being carried in the drag-link conveyor nears the upper end, it reaches a discharge opening in the ramp up which it is being pushed and falls by gravity through such opening into a chute or conduit 39 leading to a feeder 41, which is located vertically therebeneath. If it is desired to feed a sorbent material, such as limestone, into the CBC for the control of $SO_2$ in the stack gas, a hopper 43 can be provided above the drag conveyor 37 having a feed valve 45 through which particulate limestone is fed into the passing flights of the drag conveyor, controlled for example by a suitable control system which monitors the sulphur dioxide content of the stack gas exiting from the cyclone separator 23. Furthermore, a second such hopper 46 could be provided to add ash and/or sand to the contaminated soil being processed should it be so wet and sticky or gooey that it is difficult to handle and form into a plug.

The feeder 41 has a pair of upper entrances 47*a* and 47*b* and is mounted on wheels which allow it to be easily shifted between position A and position B along a set of supporting rails which are part of an underlying suitable track 49. In position A, shown in FIG. 1, the feeder has its center entrance 47*a* aligned with the conduit 39 which communicates with the discharge end of the conveyor 37. In position B (shown in FIG. 2), the rear entrance 47*b* of the feeder is aligned with the discharge chute 39. Suitable wheel stops 51 at the ends of the track 49 (see FIG. 3) assure that the feeder is accurately positioned either at position A or position B.

Figure 2:
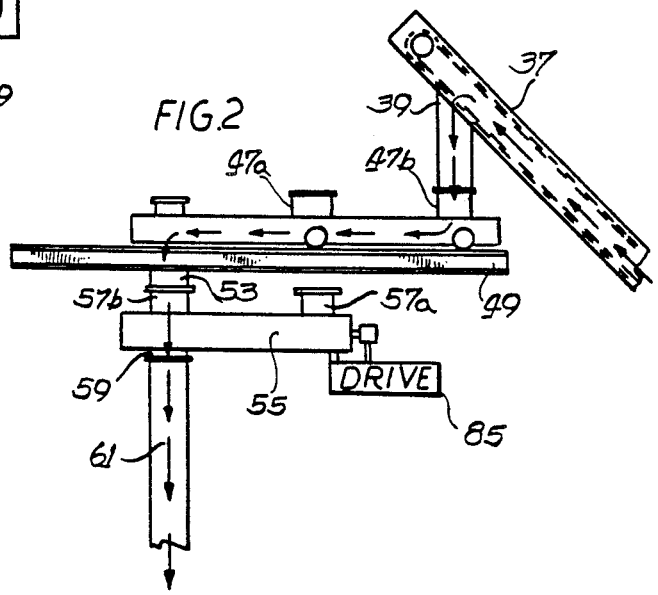
FIG. 2 is a fragmentary schematic view showing a portion of the apparatus illustrated in FIG. 1 in an alternative position.
Figures 3, 4, 5, 6:
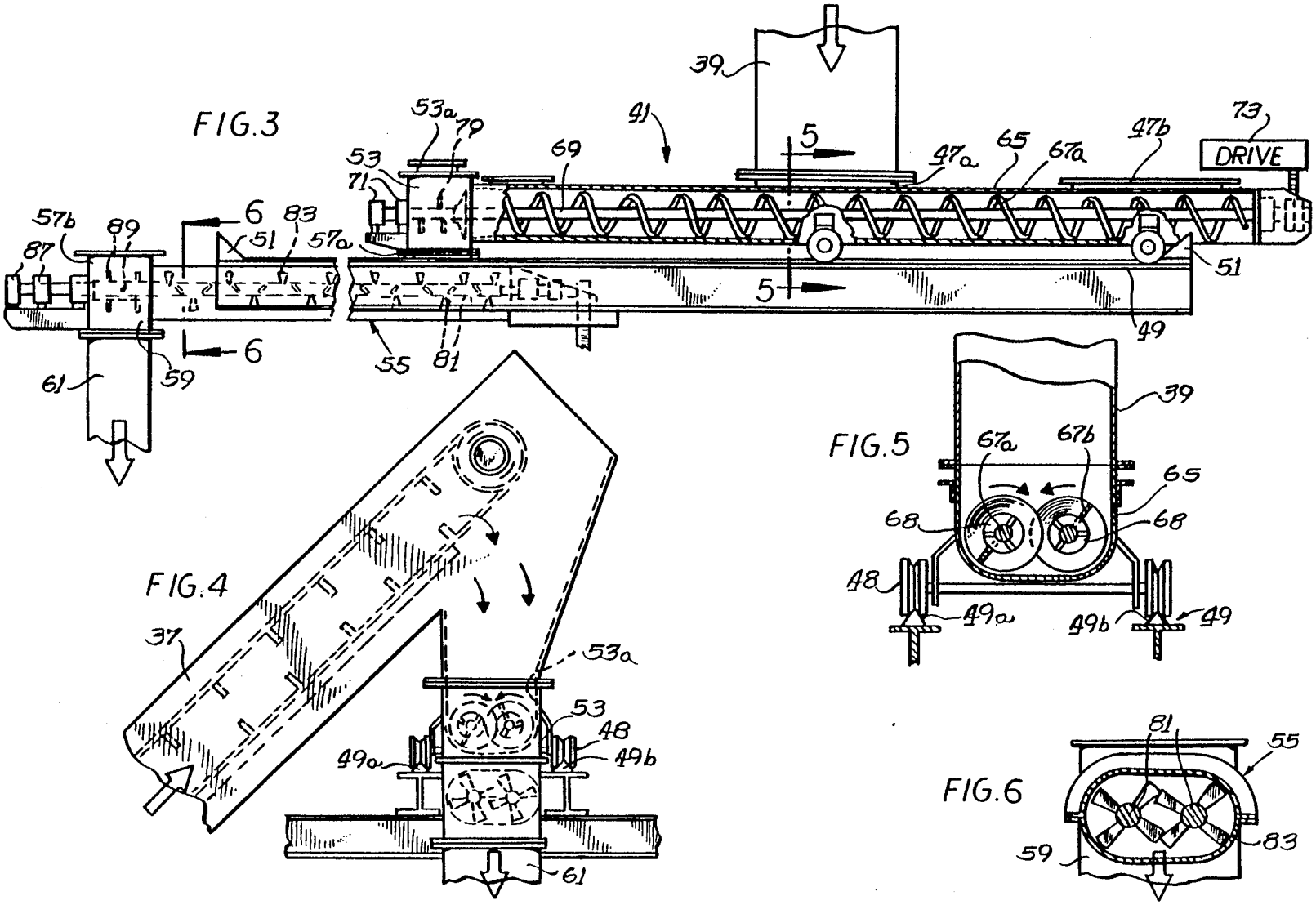
FIG. 3 is an enlarged fragmentary elevational view, with portions broken away, illustrating a portion of the apparatus depicted in FIG. 1.
FIG. 4 is a left side elevational view of the portion of the apparatus shown in FIG. 3.
FIG. 5 is a sectional view, enlarged in size, taken generally along the lines 5—5 of FIG. 3.
FIG. 6 is a sectional view, enlarged in size, generally taken along the lines 6—6 of FIG. 3.

As best seen in FIG. 5, the track 49 includes a pair of spaced-apart rails 49*a* and 49*b* and is generally open therebetween so as to not interfere with an exit conduit 53 at the discharge end of the feeder which extends therebelow in a location generally between the rails, as best seen in FIG. 4. Located below the feeder is an elongated conveyor, preferably a pug mill 55, which also has a pair of upper open 57*a* and 57*b* and which may also be partially located between the rails 49*a* and 49*b*. The upper entrance 57*a* is located adjacent the inlet end of the pug mill 55, and the entrance 57*b* is located above the discharge end of the pug mill 55. Thus, as can be seen from FIGS. 1 and 3, when the feeder is in position A, the material being discharged from the feeder 41 enters the inlet end of the pug mill 55 through the entrance 57*a* and thus traverses the entire pug mill conveyor. On the other hand, as shown in FIG. 2, when the feeder 41 is in position B, the exit conduit 53 is aligned with the outlet end of the pug mill, and the major portion of the pug mill is removed from the circuit, for reasons explained hereinafter.

The pug mill 55 discharges through a lower exit passageway section 59 which is joined to the upper end of a chute 61 leading to an opening 63 into the diagonal conduit portion 31 of the recirculation loop of the CBC. As a result, the contaminated material of desired particulate size being provided by the feeder 41 travels down to the lower end of the chute where it is mixed with the particulate material returning from the cyclone separator 23. Flanged connections are preferably provided between the exit conduit of the feeder 41 and the pug mill 55 and between the exit passageway from the pug mill and the upper end of the chute 61, which are pressure-tight connections and which allow the CBC to be operated at a pressure other than atmospheric pressure so long as it can be isolated from the conveyor 37 which operates at atmospheric pressure. Although a rotary valve might be incorporated into the system, it is difficult to feed large amounts of contaminated soil being treated through such a valve, to which it has a tendency to adhere and clog, without the expense of drying or otherwise pretreating such material; thus more acceptable solutions to the problem of isolating the atmospheric end of the conveyor from a subatmospheric incinerator were sought.

It has been found that the inclusion of the feeder 41 which is constructed so as to operate in a manner that forms a compacted plug of soil or other contaminated material creating a barrier to gas flow and thus serves to isolate the CBC from the end of the conveyor, allowing the CBC to be operated at below atmospheric pressure, as is preferred. Operation of the CBC below atmospheric conditions affords protection that, if some minor leak occurs in the system, the leak will be inward and not outward; and thus, the possibility of any contamination escaping the CBC unit is minimized. Moreover, although momentary pressure surges above atmospheric pressure might occur in a CBC, it has been found that the illustrated feeder design is adequate to withstand such surges because the plug which is created resists blowout and thus serves as an effective barrier against the outward leaking of substantially higher than atmospheric pressures within the CBC.

Figure 7:
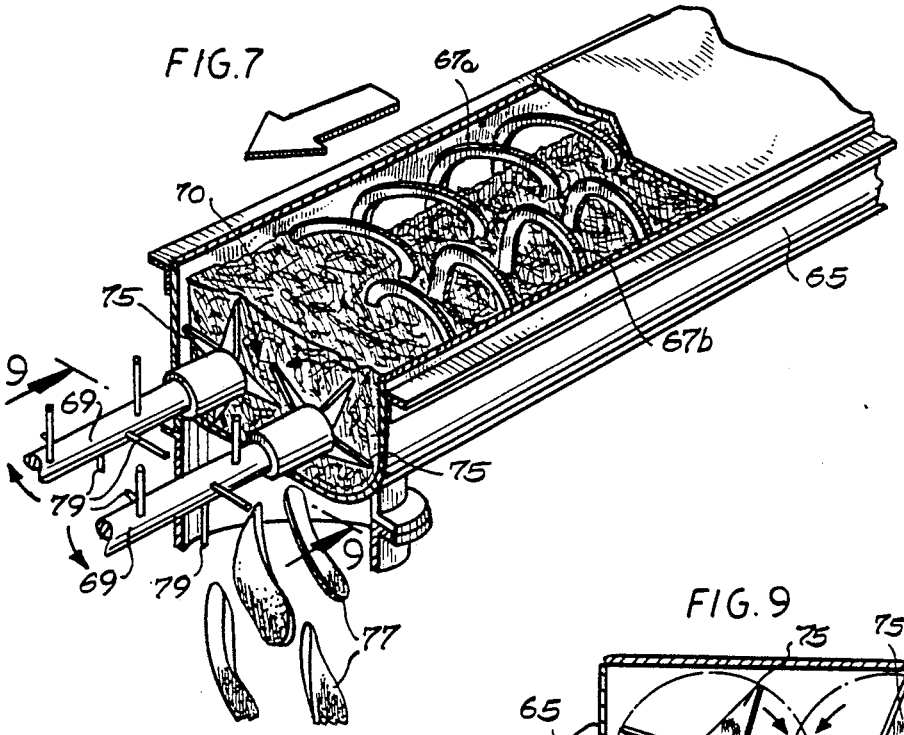
FIG. 7 is a fragmentary perspective view, enlarged in size, with portions removed or broken away, illustrating the apparatus depicted in FIG. 3 in operation, creating a plug, the downstream end of which is being sliced.
Figure 8:
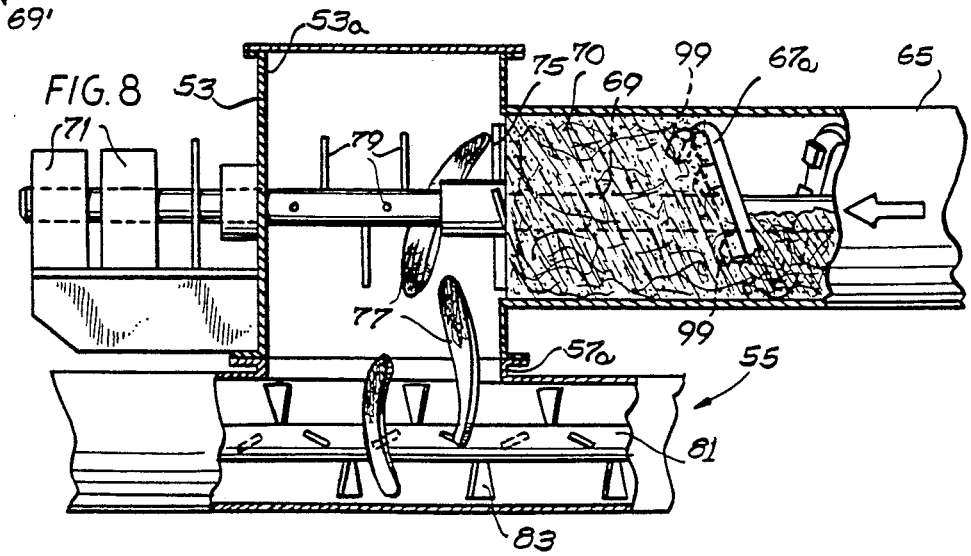
FIG. 8 is a front view, enlarged in size and partly in section, showing a portion of the apparatus depicted in FIG. 3 shown in operation.

As best seen in FIG. 3, the feeder 41 includes a housing or barrel 65 within which a pair of screws 67*a* and 67*b*, having a right hand thread and a left hand thread, respectively, counterrotate. The screws have relatively thick shafts 69 and have intermeshing flights, preferably ribbon flights, which terminate a predetermined distance short of the discharge end of the barrel as shown in FIG. 3 and which have diameters proportioned so as to approach the internal wall surface of the barrel. The material, which is being fed from right to left as shown in the drawings, is worked or kneaded by the counterrotating flights of the screws and by some rearward flow through the annular reliefs 68 in the ribbon flights. At the end of the screw flights, the soil is pressed forward toward the discharge end and agglomerated. As a result, a compacted agglomerated mass is created which forms a plug 70 across the entire cross-section of the barrel; FIGS. 7 and 8 illustrate the creation of such a plug.

Figure 9:
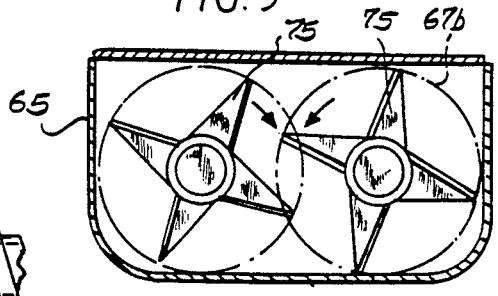
FIG. 9 is a schematic view taken generally along the line 9—9 of FIG. 7.

The shafts 69 of the screws extend out the discharge end of the housing through the exit conduit 53 and into a pair of bearings 71; a variable speed motor drive unit 73 is mounted at the opposite end and connected by a roller chain with a sprocket at the end of one shaft, the two shafts being synchronized by a pair of spur gears. Mounted on the shafts 69 are a pair of cutter heads 75 which each have four cutter blades, although they may generally have between 3 and 6 blades each. The cutter heads 75 are designed for rotation in opposite directions because they are mounted on counter-rotating shafts, and the rotation is preferably such that the blades slice inward and downward as shown in FIG. 9.

As best seen in FIGS. 7 and 8, the rotating cutter heads 75 continuously slice the agglomerated contaminated material from the downstream end of the plug 70 being extruded from the end of the barrel to create ribbons which fracture into chips or slices 77 that fall downward by gravity through the exit conduit 53 of the feeder. Depending upon the constitution of the contaminated material, the ribbons may not have a tendency to break off into chips, and such ribbons may extend downstream past the cutter heads 75. In order to break up any such ribbons, a plurality of radially oriented breaker bars 79 are suitably affixed to the shafts 69 downstream of the cutter heads, and these rotating bars effectively sever or fracture any such ribbons that might reach this region so as to help assure that the plug 70 of material that is being sliced by the cutter heads 75 is broken into discrete portions which then fall downward through the exit conduit 53. Ribbons that are not fractured by the breaker bars 79 are fractured in the underlying pug mill 55.

As is shown in FIGS. 7 and 8, the chips 77 sliced from the end of the continuously growing plug of agglomerated material fall into the entrance 57*a* of the pug-mill which also includes a pair of counterrotating shafts 81 that carry paddles 83 or the like that propel the chips from right to left as depicted in FIG. 8, further fracturing them into discrete particles. When the particles reach the left end or discharge end of the pug-mill, they fall downward through the exit passageway 59, which is joined by a flanged connection to the chute 61 leading to the recirculation loop of the CBC. As is shown in FIG. 2, the pug-mill 55 shafts are preferably driven by a drive unit 85 mounted near the right hand end which is connected to the shafts by a roller chain drive or the like. The left hand ends of the shafts 81 of the pug mill are mounted in suitable bearings 87. At the discharge end of the pug-mill in the region defined by the exit passageway section 59, the shafts 81 carry a set of delumper bars 89 that are generally similar to the breaker bars 79. When the feeder 41 is positioned as depicted in FIG. 2 so that its exit conduit 53 is connected to the entrance 57*b* at the upper end of the exit passageway section 59 of the pug-mill, the major portion of the pug-mill is removed from the circuit. However, the slices of contaminated material will then fall directly into the counterrotating delumper bars 89 through which they must pass before entering the upper end of the chute 61 leading to the recirculation loop of the CBC, which bars will fracture any ribbons that have not been broken.

In addition to being used to further breakup the chips or slices 77, the pug-mill can be employed to advantage when the slices are of wet clay material that has a tendency to reagglomerate. In such an instance, some dry ash or dry clay is added via the flanged opening 53*a* at the top of the feeder exit conduit which is located above the entrance to the pug-mill so that it will coat the slices falling through the entrance 57*a* into the pug mill and thus prevent reagglomeration and assure the contaminated material being fed to the recirculation loop of the CBC is of the desired size.

The slices exiting from the lower exit passageway section 59 of the pug-mill fall into the chute 61. Depending upon the consistency of the material, it may exert a tendency to adhere to the sidewalls of the chute and possibly result in a blockage; for example, a sticky clay material has such a tendency. However, it has been found that by maintaining the chute at a desired minimum temperature of at least 150° F. and preferably between about 200° and 250° F., adherence to the sidewalls of the chute can be positively prevented. Ancillary heating, e.g. electric resistance heating elements, could be provided to maintain this temperature; however, it has been found that it is possible to utilize the heat inherently available from the CBC and particularly from the hot solids being returned through the recirculation loop. Accordingly, thermal insulation 90 is preferably applied to the exterior of the chute 61 (see FIG. 1) which has been found adequate to trap the heat from the underlying hot particles in the recirculation loop and maintain this desired minimum temperature which prevents adherence of slices of contaminated material to the sidewall of the chute.

The screw design is determined by the throughput or capacity of the overall unit; it will be understood that the greater the amount of contaminated soil which one desires to feed per hour through the unit, the larger may be the diameters of the screws. For example, if it is desired to feed about 4.5 cubic yards of contaminated soil per hour thorough the CBC, a pair of counterrotating screws 9" in diameter may be employed which might be operated at about 15 RPM under normal conditions. Although such screws may have a shaft diameter as thin as about 2½", preferably the shaft diameter should be about 4" in order to assure that undesired deflection will not occur in the intermeshing threaded flight region as a result of rocks or other extraneous material that might be inadvertently present in contaminated soil being treated. For higher throughputs of contaminated material, a pair of 12" diameter screws may be used in which the shaft diameter in the section of the flight is about 5½" thick. Generally, the pitch of the twin screws is constant throughout the length of the screw flights; for example, a pair of 9" diameter screws may have a constant pitch. Should the contaminated material being treated be particularly sandy, it may be desirable to use a screw having a pitch which decreases toward its downstream end so that the material is subjected to some compressive forces as it travels in the screw flights even before it reaches the final location where the plug forms, and the pitch between the final flights may be reduced to about 6 inches.

It has been found desirable to normally operate the CBC so that the combustor is at a pressure of at least about 5 to 10 inches of water below atmospheric pressure near its lower end where solids are being returned. As previously indicated, operation in this fashion positively guards against a continuous leak of contaminated material outward from a faulty seal somewhere in the circulating bed combustion unit. Accordingly, it is desired that the plug 70 that is created at the discharge end of the feeder 41 be able to create a barrier or seal against any gas flow therethrough for such operating pressure plus a margin of safety on both sides of this normal operating pressure. Preferably, the feeder is designed and operated so as to effect a positive seal against pressure differences of about 30" of water thereacross. In other words, the plug should prevent any gas flow therethrough if the pressure on the downstream side is anywhere between plus 30" of water to minus 30" of water. Although the CBC would not normally be operated in the plus range, it is possible that a sporadic pressure pulse might be created causing the CBC pressure to momentarily go positive.

The length of the plug necessary to achieve this desired barrier will vary with the characteristics of the contaminated material that is being agglomerated. It has been found that a 6" plug of relatively wet material will be adequate with respect to pressure differences in this range; however, if the material is relatively dry, a plug from about 9 to 12" in length may be desirable to assure an adequate seal is maintained. Because of the characteristics of the contaminated material may vary on a day-to-day basis, depending upon the environmental conditions to which it is exposed, it has been found desirable to take this into consideration. For example, if the site in question is experiencing a long period of hot, dry weather, the contaminated soil being treated may have a relatively low moisture content. On the other hand, if a lengthy period of wet and/or colder weather is being experienced, the characteristics of the contaminated soil could vary significantly making it much stickier and adherent. Because the overall object is to form a consistent plug at the downstream end of the feeder regardless of the characteristics of the materials, it has been found to be particularly helpful to be able to build adjustability into the feeder whereby the distance can be varied between the ends of the flights of the counterrotating screws 67 and the discharge end of the housing where the rotating cutters 75 are located.

It has been found advantageous to be able to relatively simply and expeditiously vary the length between the end of the screw flights 67 and the location where the cutter blades 75 are mounted, and one way such variance can be effected is by making the shaft in a plurality of sections which interfit together. A telescoping arrangement might be employed in which one section of such a shaft, or at least an end portion of that shaft section, is formed so as to telescope into the interior of a mating cavity formed in the end of the other shaft section. For example, the downstream end of the shaft section on which the cutter heads and breaker bars are mounted might be formed so as to have a hollow interior of square or circular cross section, and the major portion of the shaft section upon which the screw flights are carried is either of complementary cross-section or has an extension of complementary cross-section protruding outward from the downstream end thereof which is received in the hollow interior of the other section of the composite shaft. With such an arrangement, variability might be achieved by mounting the drive unit for the counterrotating screws on a track which allows the longitudinal adjustment of the flighted screw sections and the associated drive unit.

Figure 10:
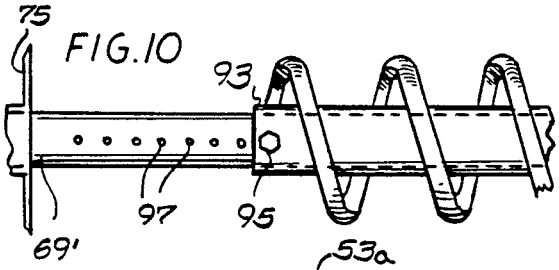
FIG. 10 is a schematic view showing a preferred construction of one of the screws illustrating its adjustability.

Another particularly advantageous design is shown in FIG. 10 and affixes screw flights 91 to a sleeve 93 of suitable length and wall thickness, e.g., about ½ to ¾ inch, that will fit over and be slidably received on the main circular shaft 69' on which the cutters 75 are mounted. The location of the sleeve 93 along the shaft 69' is then determined by aligning one or more drilled holes 95 in the sleeve with one of a series of drilled holes 97 in the shaft which may be spaced apart at one inch intervals, for example. Once aligned in the desired longitudinal location, the sleeve is secured by inserting a bolt or other detent through the aligned holes 95, 97 and securing it in position. Such an arrangement might be constructed to allow the position of the screw flights 91 within the barrel 65 to be varied at one-inch intervals over a distance of about 14" in length, thereby varying the distance between the end of the barrel and the point where the screw flights 91 terminate as desired to determine the length of the plug 70 for particular contaminated material being treated. This may allow the distance between the cutter heads and the end of the screw flights to be varied between about 4" and about 18"—an adjustment, which is considered to be adequate to handle contaminated soil of the varying characteristics that will most likely be encountered. In such an arrangement, an appropriate amount of clearance would be provided at the right hand end of the shaft to allow such adjustment.

The slices of the agglomerated material that are cut from the continuously advancing downstream end of the plug 70 should be preferably not be greater than about ½" in thickness, and when each cutter head has four blades and rotates with the shaft, this should not pose a problem because the plug 70 is not normally extruded at a rate that would create a ribbon thickness approaching such upper limit. Preferably, when the fractured slices reach the entrance 33 to the recirculation loop 29, their largest dimension does not exceed a few inches, and preferably is about 2 inches or less.

As previously indicated, the object is to maintain a consistent plug of material at the downstream end of the feeder, and the slower the screws 67 are rotated, the shorter may be the length of plug which is necessary. The void volume between the screw flights is not usually filled with the contaminated material being treated because the supply to the conveyor 37 is relied upon to meter the rate at which material is delivered to the CBC. Accordingly, when a plug is moving and growing more slowly, the contaminated material has a tendency to build up somewhat in the region between the last two flights, increasing the sealing capacity of the plug which is being formed by the more slowly rotating screws. In general, about ¼ inch clearance may be provided at the closest points of approach between the screw flights and the interior wall of the barrel, as best seen in FIG. 9. As a result, a hard lining will build up in this peripheral region which will have a tendency to grow inward into the region where the screws rotate. To deter such potentially disruptive invasion, rectangular blocks 99 of hard material, e.g., a refractory carbide, are affixed at spaced intervals, e.g. every 45°, along the edge of the leading surfaces of the screw flights (FIG. 8) which shave away any such build-up and guard against potential deflection of the screws. Furthermore, the annular reliefs 68 which are present in such a ribbon flight deter the packing of soil along the shaft, a potential problem when a solid screw flight is used to convey certain materials.

A pair of twin screws may be operated at between about 13 and 18 RPM when a clay-sand composite material is being fed. If the material is particularly sandy, about 10 RPM or below may be used, and a variable speed drive 73 can be advantageous to allow change of speed. With a very high clay content, a speed slightly above 18 RPM might be used. Counter-rotating screws are preferred and permit higher throughput because of the wider barrel; moreover intermeshing screws assist in agglomeration of the material by appropriately working it in the intermeshing central region as it travels along the length of the feeder to the downstream region where the plug is being formed. It is also possible to use a single screw, if desired, and many of the considerations mentioned hereinbefore hold true for single screw operation. The screw flight of a single screw would be similarly terminated a desired distance from the end of the barrel so that a suitable plug would form, and a similar rotary cutter could be mounted on the extension portion of the shaft to rotate with the screw and slice chips of the agglomerated material from the downstream end of the continuously advancing plug.

Although the invention has been described with regard to the presently preferred embodiments, which constitute the best mode known to the inventors for carrying out their invention, it should be understood that various changes and modifications as would be obvious to one having ordinary skill in this art, may be made without departing from the scope of the invention, which is defined in the claims appended hereto. For example, instead of using a CBC as the incinerator, a rotating kiln, or a standard fluidized bed or any other suitable combustor may be used. Although the invention is considered to be particularly well-suited for the decontamination of soil, it can also be advantageously employed to incinerate appropriate industrial waste products, e.g., mill sludge.

Particular features of the invention are emphasized are in the claims as follows.

What is claimed is:

1. Apparatus for decontaminating contaminated material by incineration thereof, which apparatus comprises an incineration unit designed for operation at a pressure below atmospheric pressure, a feeder, having a housing with an inlet end, a discharge end and a longitudinally extending barrel, for continuously agglomerating contaminated material to create a plug therefrom which plug seals the region between said inlet and discharge ends and creates a barrier that withstands significant differences in pressure between said inlet and discharge ends and thereby blocks gas flow therethrough, said feeder including a pair of intermeshing screws mounted for rotation about parallel axes in said barrel, the interior dimension of said barrel being proportioned to the exterior diameters of said intermeshing screws, and means for counterrotating said screws one to the other, said flights of both said screws being terminated short of said discharge end of said barrel whereby said plug forms in the longitudinal region between the termini of said screw flights and said discharge end of said barrel, means for supplying contaminated material to said inlet end of said housing, a pair of common drive shafts each supporting one of said screws plus a rotary cutter having a plurality of blades for slicing portions from said extruding plug, each said rotary cutter being mounted on a portion of each said drive shaft which extends axially downstream past said discharge end of said barrel and functioning to continuously slice portions from said plug as it is continuously extruded from said discharge end of said housing barrel, and means for transferring said removed portions to said incineration unit.

2. Apparatus in accordance with claim 1 wherein a plurality of radially extending elements are affixed to each of said drive shafts at locations downstream of said cutters, which elements rotate with said cutters and serve to fracture ribbons of extruded plug material crated by said cutters reaching this downstream region.

3. Apparatus in accordance with claim 1 wherein each of said common drive shaft-cutter-screw combinations is constructed with mechanical interconnections which allow axial adjustment of the longitudinal location of said screw flights within said barrel so as to alter the distance between said termini of said flights and said discharge end of said barrel and thereby change the length of said plug.

4. Apparatus in accordance with claim 3 wherein each said screw includes a central sleeve section which is slidably mounted upon said shaft and wherein means is provided for interconnecting said central sleeve section and said shaft at a plurality of different spaced-apart intervals along said shaft.

5. Apparatus for decontaminating contaminated material by incineration thereof, which apparatus comprises an incineration unit designed for operation at a pressure below atmospheric pressure, a feeder, having having a housing with an inlet end and a discharge end and a longitudinal barrel, for continuously agglomerating contaminated material to create a plug therefrom which plug seals the region between said inlet and discharge ends and creates a barrier that withstands significant differences in pressure between said inlet and discharge ends and thereby blocks gas flow therethrough, means for supply contaminated material to said inlet end of said housing, means for continuously removing portions of said plug adjacent said discharge end of said housing so as to maintain said plug at a generally constant length, means for transferring said removed portions to said incineration unit, which includes chute means through which said removed portions are fed by gravity toward an entrance to said incineration unit, and longitudinally extending conveying means disposed below said feeder to receive the portions cut from the extruded plug at the discharge end of said housing barrel and to deliver portions of said agglomerated material of desired particulate size to said chute means.

6. Apparatus in accordance with claim 5 wherein said longitudinal conveying means is a pug-mill, said housing barrel is movabley mounted on a rectilinear track that is aligned parallel with the axis of said pug-mill conveyor, said track extending at least partially above said pug-mill, said pug-mill having a first entrance above its inlet end and a second entrance above its discharge end, said feeder having a downwardly open exit conduit at the discharge end thereof which conduit can be aligned with either of said upper entrances to said pug-mill by longitudinally shifting said housing barrel along said track.

7. Apparatus for decontaminating contaminated material by incineration thereof, which apparatus comprises a circulating bed combustor designed for operation at a pressure below atmospheric pressure, a feeder, having a housing with an inlet end and a discharge end, for contiguously agglomerating contaminated material to create a plug therefrom which plug seals the region between said inlet and discharge ends an creates a barrier that withstands significant differences in pressure between said inlet and discharge ends and thereby blocks gas flow therethrough, means for supplying contaminated material to said inlet end of said housing, means for continuously removing portions of said plug adjacent said discharge end of said housing so as to maintain said plug at a generally constant length, separator means for separating particulate solids from a fluid exhaust steam from said circulating bed combustor, recirculation means for returning at least a portion of said separated solids to said combustor, and means for transferring said removed portions to said combustor including chute means through which said removed portions of contaminated material are fed by gravity to said recirculation means for delivery to said combustor together with said separated solides being returned.

8. Apparatus in accordance with claim 7 wherein means is provided for maintaining the walls of said chute means at a minimum temperature of at least abut 150° F.

9. Apparatus in accordance with claim 8 wherein said minimum temperature is maintained by the presence of insulation affixed to the exterior surface of said chute means.

10. A method for contaminating contaminated material, which method comprises operating an incinerator generally at a pressure below atmospheric pressure, supplying contaminated material to a feed chamber and continouously working with a pair of counter-rotating screws to agglomerate said contaminated material to create a plug therefrom so as to seal said feed chamber to block gas flow therethrough, continuously removing portions of said plug at the downstream end thereof so as to maintain said plug at a generally constant length by slicing into multiple ribbons using rotating cutters and thereafter fracturing said ribbons into portions of desired size, and transferring said removed portions to said incinerator wherein contaminants contained therein are subjected to destruction by thermal oxidation.

11. A method for decontaminating contaminated material, which method comprises operating a circulating bed combustor generally at a pressure below atmospheric pressure, supplying contaminated material to a feed chamber and continuously agglomerating said contaminated material to create a plug therefrom so as to seal said feed chamber to block gas flow therethrough, continuously removing portions of said plug at the downstream end thereof so as to maintain said plug at a generally constant length, separating particulate solids from a fluid exhaust steam from the circulating bed of said combustor and returning at least a portion of said separated solids to said combustor via a recirculation loop, and transferring said removed portions of said recirculation loop so that they are delivered to said combustor, together with said separated solids being returned, wherein contaminants contained therein are subjected to destruction by thermal oxidation.

* * * * *